United States Patent [19]

Gillies

[11] Patent Number: 4,579,129

[45] Date of Patent: Apr. 1, 1986

[54] CIGARETTE RESTS FOR ASHTRAYS

[76] Inventor: David A. Gillies, 5 Nutcombe Height, Hindhead, Surrey, England

[21] Appl. No.: 599,262

[22] Filed: Apr. 11, 1984

[30] Foreign Application Priority Data

Apr. 21, 1983 [GB] United Kingdom ..... 8310896
Feb. 20, 1984 [GB] United Kingdom ..... 8404382

[51] Int. Cl.[4] ..... A24F 19/00
[52] U.S. Cl. ..... 131/240.1; 131/231
[58] Field of Search ..... 131/231, 240 R, 240 GG, 131/242, 257

[56] References Cited

U.S. PATENT DOCUMENTS

| | | | |
|---|---|---|---|
| 1,948,025 | 2/1934 | Currier, Jr. | 131/240 R |
| 2,156,738 | 5/1939 | Ryan | 131/240 R |
| 2,335,973 | 12/1943 | Segal | 131/240 R |
| 2,453,790 | 11/1948 | Foddy | 131/240 R |
| 2,495,185 | 1/1950 | Schmitt | 131/240 R |
| 4,018,236 | 4/1977 | Ehlen | 131/240 R |
| 4,108,153 | 8/1978 | Pearson | 131/240 R |

*Primary Examiner*—V. Millin
*Assistant Examiner*—H. Macey
*Attorney, Agent, or Firm*—Browdy and Neimark

[57] ABSTRACT

A cigarette rest for an ashtray 2 having a bowl for cigarette ash, the rest comprising first and second supports 6 and 14 for supporting forward and rearward ends, respectively, of a cigarette, each support being capable of supporting no more than a short length of the cigarette and the support surface of the second support 14 being at a level below that of the support surface of the first support 6, and, on the other side of the second support from the first support a lip 16 which limits the rearward axial movement of a cigarette resting on the supports, the first support surface being located at a distance from the lip equal to at least half the length of the cigarette and the second support surface being located nearer to the lip than to the first support, the rest being so constructed and arranged that the tip of a cigarette resting thereon with the butt end lowermost will project over the bowl of the ashtray.

2 Claims, 4 Drawing Figures

CIGARETTE RESTS FOR ASHTRAYS

This invention relates to a cigarette rest for an ashtray.

In general, ashtrays comprise a receptacle or bowl for ash surrounded by a raised rim on which a lighted cigarette may rest. In most exciting designs of ashtray, the resting cigarette either rests on the raised rim with the burning tip pointing generally inwards towards the bowl, and perhaps slightly downwards, or is lodged in a channel or groove which is formed in the rim and is designed to stop the cigarette from slipping or rolling sideways. However, in both these cases a neglected cigarette commonly either falls forward until the burning tip is resting in the ash receptacle or, as it burns down, tends to overbalance outwards. The former tends to cause greatly increased odour and the latter can constitute a fire danger.

It is an object of the present invention to provide a cigarette rest which reduces or prevents such occurances.

According to the present invention, there is provided a cigarette rest for an ashtray having a bowl for cigarette ash, said rest comprising first and second supports for supporting forward and rearward ends, respectively, of a cigarette, each support being capable of supporting no more than a short length of the cigarette and the support surface of the second support being at a level below that of the support surface of the first support, and, on the other side of the second support from the first support, a lip which limits the rearward axial movement of a cigarette resting on said supports, the first support surface being located at a distance from said lip equal to at least half the length of the cigarette and the second support surface being located nearer to the lip than to the first support, the rest being so constructed and arranged that the tip of a cigarette resting thereon with the butt end lowermost will project over the bowl of the ashtray.

In general, it will be desirable for the second support surface to be adjacent to the lip (hereinafter referred to as the outer lip).

In operation, the intended manner of employment of the rest is that a lighted cigarette is placed on the first and second supports with the lighted end, or tip, uppermost and the butt end adjacent to, but for hygienic reasons preferably not touching, the lip. As the centre of gravity of the cigarette lies between the first and second supports, it cannot fall into the bowl of the ashtray. It is also prevented from sliding or falling outwards by the lip.

Cigarettes are sold in different sizes, e.g. standard, king and super-king size. Where the rest is intended to be used for cigarettes of more than one size, it is preferred that the distance between the first support surface and the outer lip is less than the length of the shortest cigarette for which the rest is designed and preferably not more than slightly in excess of one-half the length of the longest cigarette for which the rest is designed.

The utility of the cigarette rest of the invention is substantially improved if there are provided between the first and second supports a further, i.e. third, support. This further support is intended to support the rearward end of a cigarette which has been smoked to the extent that it is now too short to be supported by the first and second supports. Thus, like the second support, the support surface of this further support will also be at a level below that of the first support and is capable of supporting no more than a short length of the cigarette.

A further lip, hereinafter referred to as the inner lip and which is intended to have the same function as the outer lip but for a cigarette resting on the first and third supports, may be located on the other side of said third support from said first support, i.e. between the second and third supports, to limit the rearward axial movement of a cigarette resting on said first and third supports. Said third support surface will be located nearer to this inner lip than to said first support surface and advantageously is adjacent to the lip.

It will be understood that no part of said third support or inner lip must extend above the plane in which said first and second support surfaces lie. Preferably, the highest part of said third support lies below said plane so that no part of said support will come into contact with a cigarette resting on said first and second supports. In this case, the second support may provide a surface which may act as the lip for a cigarette resting on the first and third supports.

After a cigarette has burned back to a length such that it cannot readily be supported by the first and second supports, it can be placed so that it is now supported by the first and third supports where it slopes upwardly towards the tip with the butt adjacent to, but preferably not touching, the inner lip (or second support where this is employed as the lip).

In a preferred arrangement, this inner lip, where provided, is about mid-way between the first support surface and the outer lip. However, if desired one or more further supports and associated lips may be located between the first and second supports, at appropriately spaced intervals, although this will increase the complexity of the rest.

For hygienic and practical reasons, it is preferred that the area of the cigarette surface that is contacted by the supports of the cigarette rest be kept at a minimum. In general, the widths of the surfaces of said supports will therefore be no more than about 5 mm and generally will be substantially less than that. Preferably the support surfaces are as narrow as possible without cutting or otherwise damanging the cigarette, e.g. about 0.5 to 2 mm wide. Preferably they are in the form of narrow rounded ledges.

It is likewise preferred that each of the lip is so designed as to make minimal contact with the face of the butt end of a cigarette which may come into contact with it. For example, the lip may take the form of a surface which extends in a plane generally normal to that of the cigarette axis and is curved convexly.

Similarly any grooves provided in support surfaces to prevent or limit sideways rolling of a cigarette are preferably profiled to provide minimal contact with the cigarette. For example, the distance across the mouth of the groove may be less than the cigarette diameter.

The cigarette rest of the invention may comprise an integral part of an ashtray, e.g. by appropriate design of the rim of an ashtray, or it may be in the form of an accessory e.g. for demountably mounting on the rim of a suitably designed ashtray.

The invention is now illustrated with reference to three embodiments and with the aid of the accompanying drawings, not necessarily to scale, in which FIG. 1 is a vertical cross-section of a cigarette rest which is formed integrally with an ashtray;

Figure 1:
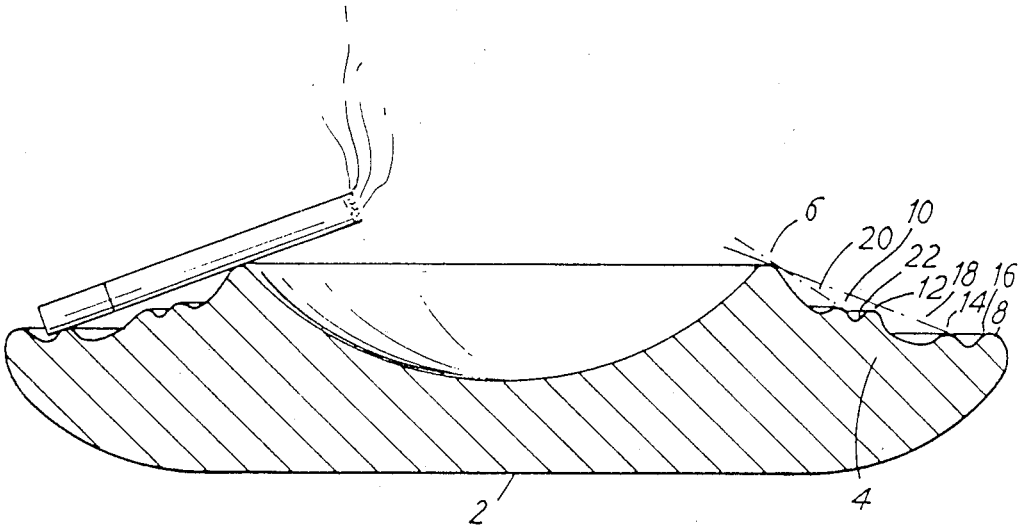

FIG. 1 shows an ashtray 2 provided with a relatively wide rim 4 which is generally dish-shaped in vertical cross-section with an inner lip 6 and an outer lip 8. Between the inner lip 6 and the outer lip 8 are three upwardly projecting portions 10, 12, and 14.

The first support surface for a cigarette resting on said rim is provided by the tip of the inner lip 6. The second support surface is provided by the projection 14, the upper surface of which is therefore at a level below that of the tip of the inner lip 6, the vertical difference between them being preferably about 5 to 15 mm. The outer lip 8 projects above the plane, represented by broken line 18, in which the tip of lip 6 and the upper surface of projection 14 lie, and includes an inwardly facing surface 16 which extends generally downwardly from the tip of the lip and provides the outer lip of the cigarette rest of the invention.

The distance between the tip of the lip 6 and the inwardly facing surface 16 of lip 8 is preferably slightly over half the length of a king-size cigarette, e.g. about 46 to 50 mm, or, if the rest is intended for use with super-king-size cigarettes, slightly over half the length of such a cigarette, e.g. 51 to 55 or 58 mm.

Projection portion 14 is preferably relatively close to said face of outer lip 8, e.g. about 5 to 15 mm therefrom, or even less.

Upwardly projecting portions 10 and 12 provide a third support and inner lip, respectively. The tip of upwardly projecting portion 10 is thus at a level below, and preferably about 5 to 15 mm below, that of the tip of lip 6. Projecting portion 12, however, extends above the plane represented by the broken line 20, in which the tips of lip 6 and projecting portion 10 lie, and has an inwardly facing surface 22 which provides the lip associated with said third support. Face 22 is about halfway between the tip of lip 6 and face 16 of outer lip 8. The tip of projecting portion 10 is preferably relatively close to said face 22, e.g. spaced 5 to 10 mm therefrom or even less.

The tips of projecting portions 10 and 12 lie below the plane in which the tips of lip 6 and projecting portion 14 lies whereby no part of said projecting portions 10 and 12 come into contact with a cigarette which is resting on the tip of lip 6 and the tip of projecting portion 14.

Preferably, the lip 6 and more preferably also the projecting portions 10 and 14, are provided with grooves to assist location of a cigarette which is supported by lip 6 and one or other of projecting portions 10 and 14, whereby to prevent the cigarette rolling or slipping sideways.

The ashtray illustrated in FIG. 1 may be formed of any suitable material, e.g. moulded from glass, plastics or ceramic material, pressed from metal, or made of natural stone or mineral.

Figure 2:
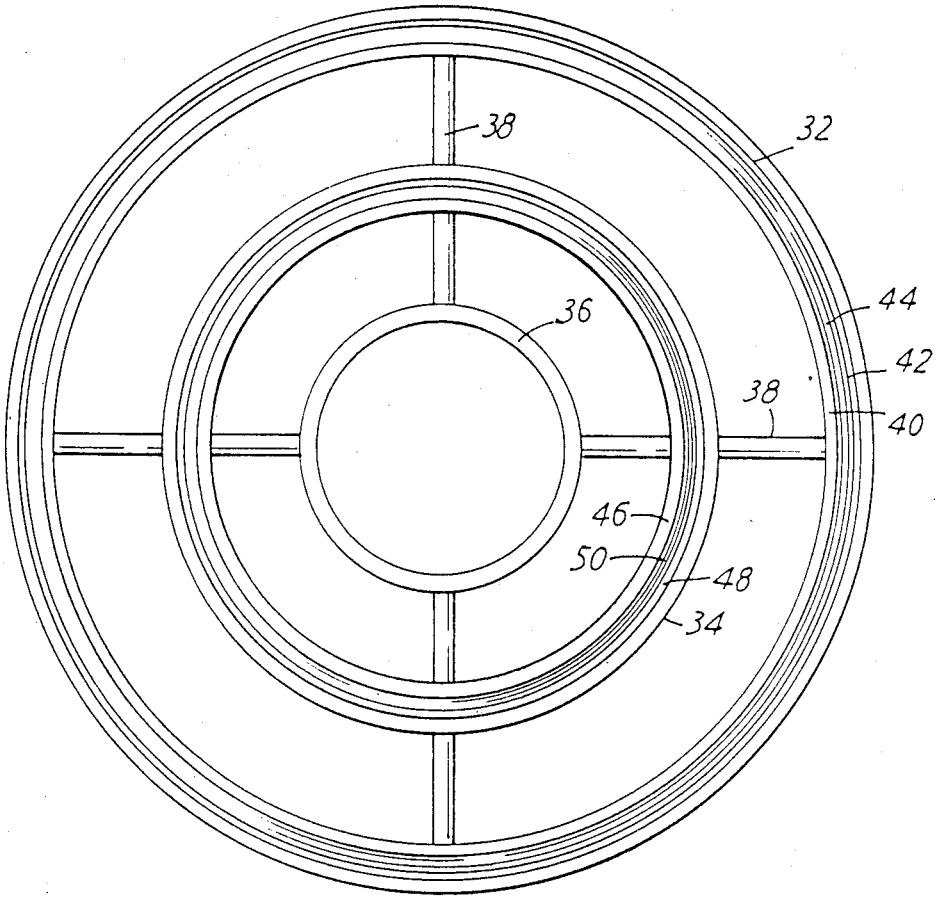
FIG. 2 is a plan view of a cigarette rest designed to be demountably mounted on the rim of an ashtray.
Figure 3:
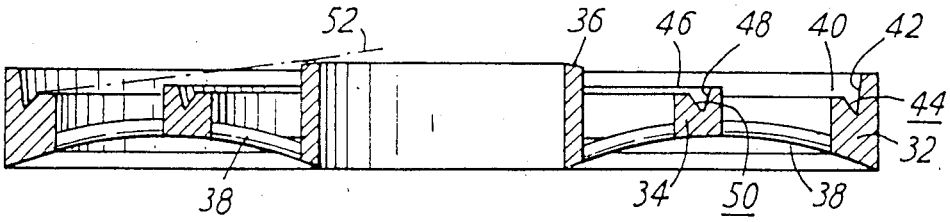
FIG. 3 is a vertical cross-section through the cigarette rest illustrated in FIG. 2.

In FIGS. 2 and 3, there is illustrated a cigarette rest designed to be fitted on top of a suitably formed ashtray. The rest comprises three circular ribs 32, 34 and 36 connected together in spaced relationship by radial ribs 38. Innermost rib 36 provides the first support of the cigarette rest of the invention. Outermost rib 32 is provided with an inwardly facing step having a land 40 and upwardly extending surface 42. Between land 40 and upwardly extending surface 42 is a notch 44. Land 40 provides the second support of the cigarette rest and upwardly extending surface 42 provides the outer lip.

The middle rib, 34, is likewise provided with an inwardly facing step having a land 46, an upwardly extending surface 48 and a notch 50 between the land and the upwardly extending surface. The land 46 provides a third support surface of the rest and upwardly extending surface 48 provides the inner lip. Thus, when the rest is placed on an ashtray on a horizontal surface, lands 40 and 46 both lie below the level of the top surface of rib 36, and land 46 and the top of upwardly extending surface 48 both lie below the notional plane, indicated by the broken line 52, in which the top of rib 36 and land 40 lies.

The under-surfaces of the radial ribs 38 may be provided with any suitable shape as required for location of the cigarette rest on the rim of a suitably designed ashtray.

The rest may be formed from any suitable material. For example, it may be moulded from plastics or vacuum formed from plastics sheet or may be a metal pressing.

Figure 4:
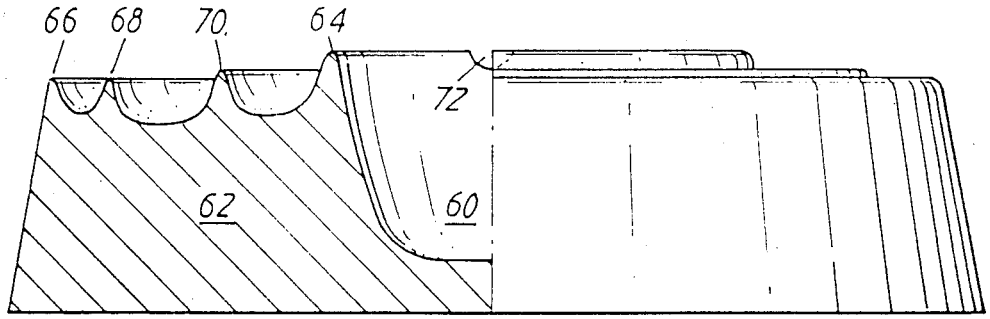
FIG. 4 is a part vertical elevation, part vertical cross-section of a second form of cigarette rest integrally formed with an ashtray.

The embodiment illustrated in FIG. 4 comprises an ashtray having an integral rest in accordance with the invention. The ashtray comprises a deep circular bowl 60 which may be of any suitable diameter and which comprises a receptacle for ash. Surrounding the bowl is a wide rim 62 having an inner lip 64 which provides the first support, an outer lip 66 the inwardly facing wall of which provides the lip for a cigarette resting on the first and second supports, and intermediate circular ledges 68 and 70 which provide, respectively, the second and third supports for the cigarette rest of the invention. Adjacent lips and ledges are separated from each other by rounded valleys and the tips of each of the supports and of the outer lip 66 are rounded.

The tip of outer ledge 68, forming the second support surface of the rest, is below that of the inner lip 64 and the tip of the inner ledge 70, forming the third support surface, lies below the plane in which the tips of ledge 68 and lip 64 lie. Thus, the inwardly facing wall of ledge 68 may act as a lip for a cigarette resting on inner lip 64 and ledge 70.

Lip 64 and each of ridges 68 and 70 may be provided with a plurality of radially extending grooves, as at 72, to assist in locating a cigarette.

The following are suitable dimensions.

Total radial distance between the tip of outer lip 66 and the tip of inner lip 64: 56.5 mm Total radial distance between the tip of outer lip 66 and the tip of ledge 68: 12.0 mm Total radial distance between the tip of ledge 68 and tip of ledge 70: 22.0 mm Vertical distance between the tip of inner lip 64 and the tip of outer lip 66: 5.5 mm Vertical distance between the tip of inner lip 64 and the tip of ledge 70: 3.5 mm Vertical distance between the tip of inner lip 64 and the tip of ledge 68: 5.0 mm Radius of groove 72: 3.5 mm It will be understood that the forms of cigarette rest illustrated in the drawings may be altered without departing from the invention. For example, one or more of the operational surfaces of the ribs 32, 34 and 36 of the embodiment illustrated in FIG. 2 may have a curved outline such as possessed by the corresponding surfaces of the embodiment illustrated in FIG. 1, rather than the angular outline shown in FIG. 3, and vice versa. Likewise, while the embodiments illustrated in the drawings are circular in plan view, other shapes may also be adopted, e.g. oval, square, triangular, polygonal, oblong or a more fancy shape such as clover-leaf. It will also be understood that the grooves 44 and 50 in the embodiment illustrated in FIGS. 2 and 3 can be replaced by grooves having different outlines in vertical cross-section or omitted altogether. Other alterations to and modifications of the design and forms of the embodiments described herein may also be made without departing from the scope of the invention.

I claim:

1. A cigarette rest for an ashtray having a bowl for cigarette ash, said rest comprising spaced first and second supports for supporting forward and rearward ends, respectively, of a cigarette, each support being in the form of a narrow ledge which supports no more than a short length of the cigarette and the support surface of the second support being at a level below that of the support surface of the first support, and, on the other side of the second support from the first support, and spaced from the second support, a lip which projects above the plane in which the support surfaces of the first and second supports lie and limits the rearward axial movement of a cigarette resting on said supports, the first support surface being located at a distance from said lip equal to at least half the length of an unburned cigarette and the second support surface being located nearer to the lip than to the first support, said rest further including, between the first and second supports, a third support, the support surface of said third support lying below the plane in which said first and second surface supports lie and being in the form of a narrow ledge which supports no more than a short length of cigarette.

2. An ashtray including an integral cigarette rest as claimed in claim 1.

* * * * *